United States Patent [19]

Takeda et al.

[11] Patent Number: 4,889,079

[45] Date of Patent: Dec. 26, 1989

[54] CYLINDER HEAD COOLING STRUCTURE FOR WATER-COOLED MULTICYLINDER ENGINE

[75] Inventors: Akihiko Takeda, Saitama; Hiroyuki Kaneda, Tokyo; Shigeru Suzuki, Saitama, all of Japan

[73] Assignee: Honda Giken Kogyo Kabushiki Kaisha, Tokyo, Japan

[21] Appl. No.: 270,958

[22] Filed: Nov. 14, 1988

[30] Foreign Application Priority Data

Nov. 17, 1987 [JP] Japan ..... 62-290305

[51] Int. Cl.[4] ..... F02F 1/38

[52] U.S. Cl. ..... 123/41.82 R; 123/193 H

[58] Field of Search ..... 123/41.72, 41.74, 41.79, 123/41.82 R, 193 H, 193 CH

[56] References Cited

U.S. PATENT DOCUMENTS

| | | | |
|---|---|---|---|
| 3,769,948 | 11/1973 | Feichtinger et al. | 123/41.82 R |
| 4,436,066 | 3/1984 | Formia et al. | 123/41.82 R |
| 4,455,973 | 6/1984 | Stadler et al. | 123/41.82 R |
| 4,590,894 | 5/1986 | Ishida et al. | 123/41.74 |
| 4,641,609 | 2/1987 | Tanaka | 123/41.82 R |
| 4,644,910 | 2/1987 | Kawamura | 123/41.82 R |
| 4,660,527 | 4/1987 | Tanaka et al. | 123/41.82 R |
| 4,690,105 | 9/1987 | Kanda | 123/41.82 R |

FOREIGN PATENT DOCUMENTS

| | | |
|---|---|---|
| 61-157144 | 9/1986 | Japan . |
| 2175046 | 11/1986 | United Kingdom . |

*Primary Examiner*—Noah P. Kamen

*Attorney, Agent, or Firm*—Lyon & Lyon

[57] ABSTRACT

A cooling structure in a cylinder head of a water-cooled multicylinder engine has partitions disposed between cylinders and in a water jacket defined in the cylinder head, cooling inlet ports disposed on one side of plug insertion tubes extending vertically and disposed above substantially central portions of the cylinders and a cooling water discharge port disposed on the other side of the plug insertion tubes, and walls projecting from the partitions toward the plug insertion tubes. Each of the walls includes a lower projecting portion having a relatively small width near a wall of the cylinder head above a combustion chamber defined in each of the cylinders and an upper projecting portion having a relatively large width.

9 Claims, 2 Drawing Sheets

CYLINDER HEAD COOLING STRUCTURE FOR WATER-COOLED MULTICYLINDER ENGINE

BACKGROUND OF THE INVENTION

1. Field of the Invention

The present invention relates to a structure for cooling the cylinder head of a water-cooled multicylinder engine.

2. Description of the Relevant Art

Japanese Laid-Open Utility Model Publication No. 61-157144 discloses a structure for cooling the cylinder head of a water-cooled multicylinder engine.

The disclosed cylinder head has an array of cylinders defined therein. Exhaust valves are disposed on one side of cylinder head along the array of cylinders, and intake valves are disposed on the other side of the cylinder head. The cooling structure includes a water jacket positioned above the cylinders from said one side to the other side of the header head and extending along the cylinder array. The water jacket has therein partitions extending along the cylinder array and each disposed between adjacent two of the cylinders. Two adjacent partitions define therebetween a water jacket compartment located above one of the cylinders. Each water jacket compartment has cooling water inlet ports disposed near the exhaust valve and a cooling water outlet port disposed near the intake valve. A spark plug insertion tube is disposed in each of the water jacket compartments directly above the center of the corresponding cylinder.

In the cylinder head cooling structure, cooling water in the water jacket compartments associated with the respective cylinders first cools the valve seats for the exhaust valves and the exhaust passages extending from the exhaust valves, and then cools the bottom wall of the water jacket and the spark plug insertion tubes which are positioned above the respective cylinders. Thereafter, the cooling water cools the valve seats for the intake valves and the intake passages extending toward the intake valves.

Walls project from the partitions toward the spark plug insertion region in each of the water jacket compartments for guiding the cooling water toward the spark plug insertion tube when it passes over the cylinder, thereby efficiently cooling the spark plug insertion tube.

The present invention has been made in an effort to improve the aforesaid cylinder head cooling structure.

SUMMARY OF THE INVENTION

It is an object of the present invention to provide a structure for cooling the cylinder head of a water-cooled multicylinder engine, which structure is capable of reliably and efficiently cooling valve seats, exhaust passages, intake passages, and spark plug insertion tubes which are positioned above cylinders defined in the cylinder head.

According to the present invention, there is provided a cooling structure in a cylinder head of a water-cooled multicylinder engine, comprising: a plurality of partitions disposed between cylinders and in a water jacket defined in the cylinder head; a plurality of plug insertion tubes disposed vertically above substantially central portions of the respective cylinders; a plurality of cooling inlet ports disposed on one side of the plug insertion tubes and a cooling water discharge port disposed on the other side of the plug insertion tubes; and a plurality of walls projecting from the partitions toward the plug insertion tubes. each of the walls including a lower projecting portion having a relatively small width near a wall of the cylinder head above a combustion chamber defined in each of the cylinders and an upper projecting portion having a relatively large width.

The above and further objects, details and advantages of the present invention will become apparent from the following detailed description of a preferred embodiment thereof, when read in conjunction with the accompanying drawings.

DESCRIPTION OF THE PREFERRED EMBODIMENT

Figure 1:
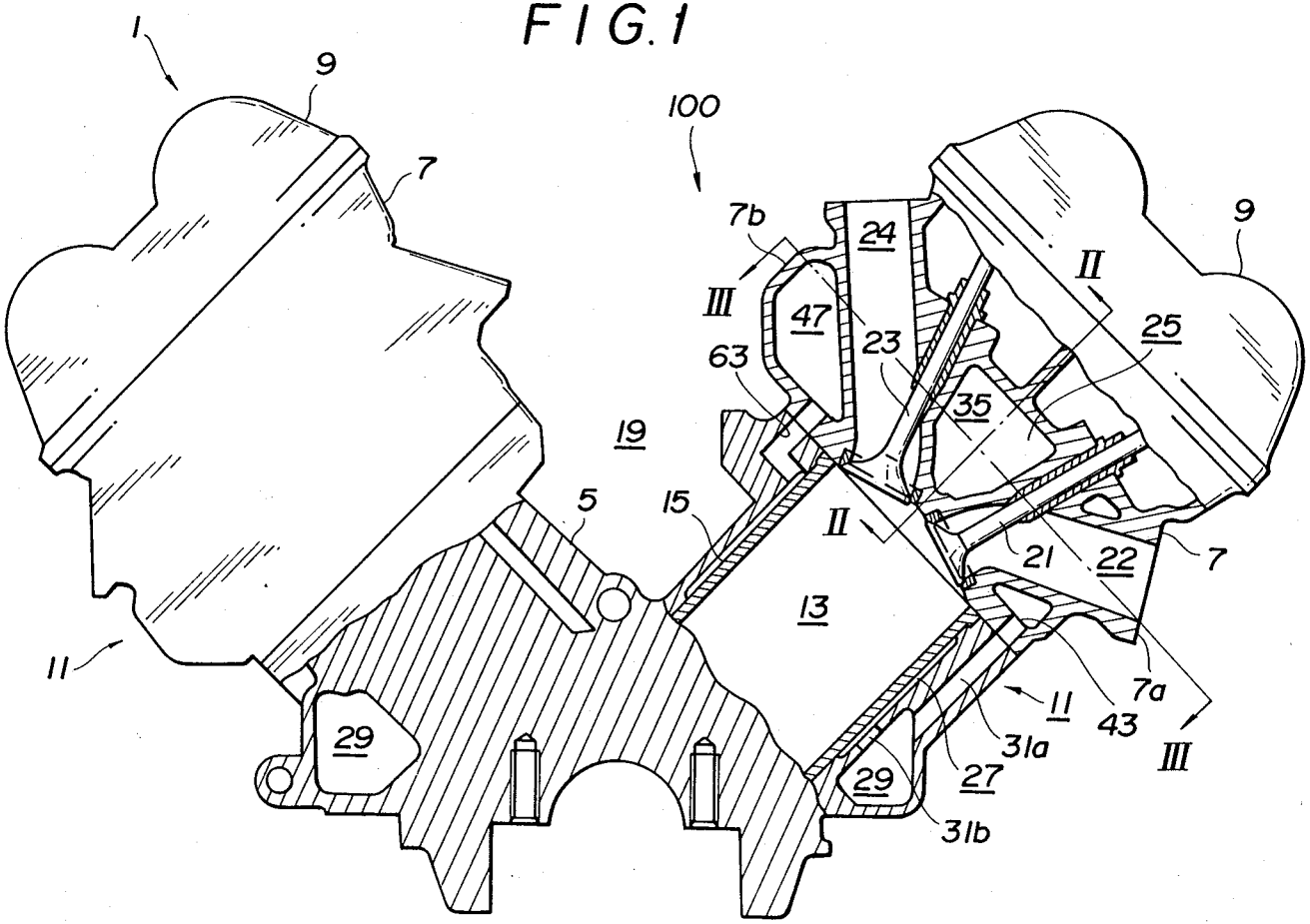
FIG. 1 is a vertical cross-sectional view, partly in front elevation, of a water-cooled multicylinder engine having a cylinder head cooling structure according a preferred embodiment of the present invention.

As shown in FIG. 1, a cylinder head cooling structure, generally designated by the reference numeral 100, according to a preferred embodiment of the present invention is incorporated in a water-cooled V-shaped 8-cylinder engine 1. The engine 1 comprises a cylinder block 5, two cylinder heads 7, and head covers 9 mounted respectively on the cylinder heads 7. The cylinder block 5 and the cylinder heads 7 jointly provide two laterally spaced arrays of four cylinders 11 in a V shape, the arrays of cylinders 11 extending perpendicularly to the sheet of FIG. 1. The cylinders 11 have respective cylinder bores 13 defined in respective wet-type cylinder liners 15 disposed in the cylinder block 5. The arrays of cylinders 11 define a V-shaped space 19 therebetween.

Since the arrays of cylinders 11 are identical in construction, only the righthand array (as viewed in FIG. 1) of cylinders 11 will be described below.

Figure 3:
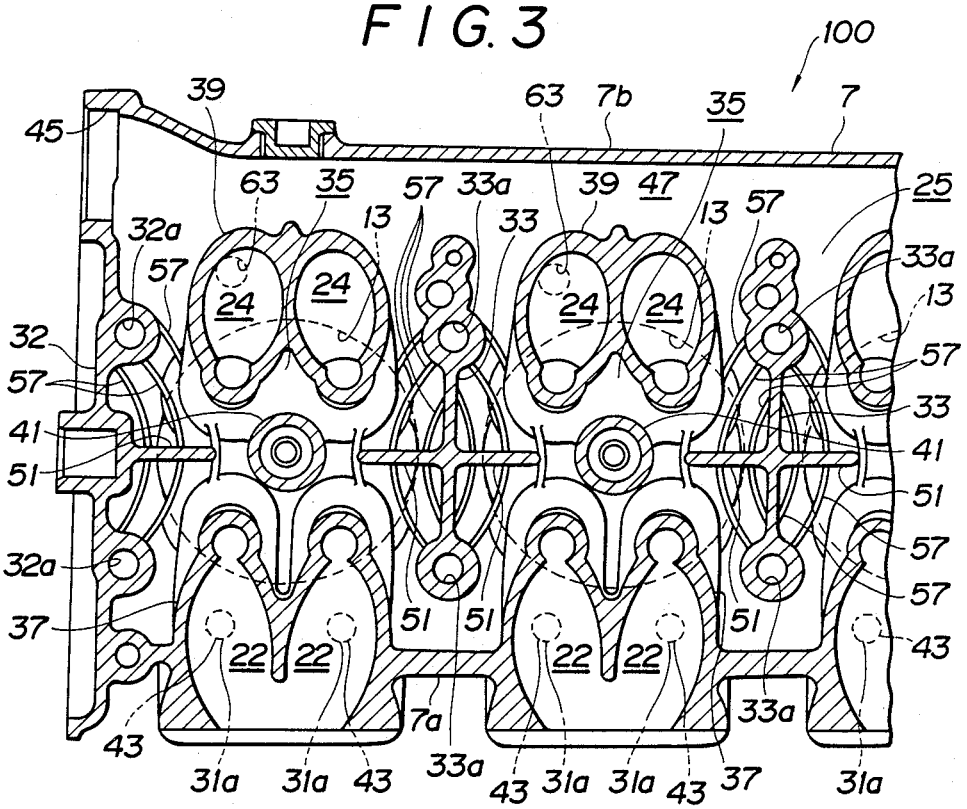
FIG. 3 is a cross-sectional view taken along line III—III of FIG. 1.

As shown in FIGS. 1 and 3, two exhaust valves 21 per cylinder 11 are disposed in one side **7*a* of the cylinder head 7 which is remote from the V-shaped space 19 in a direction normal to the array of cylinders 11. Similarly, two intake valves 23 per cylinder 11 are disposed in the other side 7*b* of the cylinder head 7 which is close to the V-shaped space 19. The cylinder head 7 also has defined therein intake passages 24 for introducing intake air into the cylinder bores 13 and exhaust passages 22 for discharging exhaust gases from the cylinder bores 13**.

The cylinders 11 are cooled by cooling water flowing through a water jacket 25 defined in the cylinder head 7, and water jackets 27 defined in the cylinder block 5 around the cylinder liners 15.

More specifically, the cylinder block 5 has a cooling water supply passageway 29 defined in a lower end portion thereof alongside of the cylinders 11 and extending along the array of cylinders 11. One end of the cooling water supply passageway 29 is supplied with cooling water which is forcibly delivered by a water pump (not shown). The cooling water supplied to the cooling water supply passageway 29 is then supplied into the water jackets 25, 27 through branch passages **31*a* and ports 31*b***.

Figure 2:
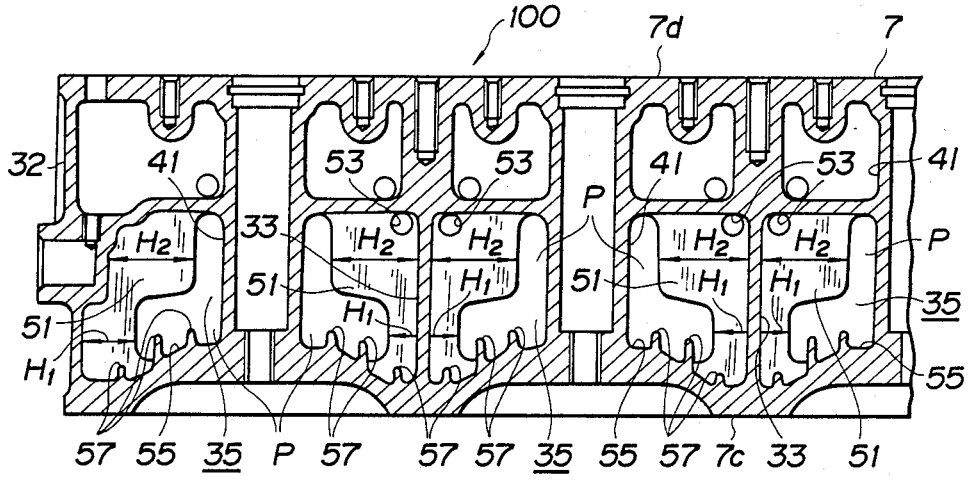
FIG. 2 is a cross-sectional view taken along line II—II of FIG. 1.

The water jacket 25 in the cylinder head 7 is shown in detail in FIGS. 2 and 3. As shown in FIG. 3, the water jacket 25 is defined between the opposite sides 7a, 7b of the cylinder head 7 and extends along the array of cylinders 11. The exhaust passages 22, the intake passages 24, and plug insertion tubes 41, etc., are cooled by cooling water flowing through the water jacket 25.

The cylinder head 7 has spaced partitions 33 of a prescribed length each disposed in the water jacket 25 between adjacent two of the cylinders 11, the partitions 33 extending perpendicularly to the array of cylinders 11. One end wall 32 of the water jacket 25, the other end wall thereof (not shown), and the partitions 33 have bolt insertion holes 32a, 33a through which bolts are inserted to fasten the cylinder head 7 to the cylinder block 5. The water jacket 25 are divided by the partitions 33 into water jacket compartments 35 defined between the partitions 33 and the end walls 32. The other side 7b of the cylinder head 7 has a communication passage 47 defined therein which extends along the array of cylinders 11 to provide communication between the water jacket compartments 35.

The plug insertion tubes 41 through which respective plugs (not shown) are inserted are formed in the respective water jacket compartment 35 above the centers of the cylinder bores 13 and extend in coaxial alignment therewith. The plug insertion tubes 41 extend from a lower side 7c to an upper side 7d of the cylinder head 7. A tubular exhaust wall 37 which defines the exhaust passages 22 and a tubular intake wall 39 which defines the intake passages 24 are formed in the cylinder head 7 on opposite sides of each of the plug insertion tubes 41.

The lower side 7c of the cylinder head 7 has cooling water inlet ports 43 defined therein and opening respectively toward the exhaust passages 22 and cooling water inlet ports 63 defined therein and opening respectively toward the tubular intake walls 39. The cooling water inlet ports 43 open into the water jacket 25 and are held in communication with the branch passages 31a, respectively. The end wall 32 of the cylinder head 7 has a discharge port 45 defined therein for discharging cooling water from the communication passage 47 toward a radiator (not shown).

As shown in FIG. 2, walls 51 project from one side of a longitudinally central portion of each end wall 32 and opposite sides of longitudinally central portion of the partitions 33 toward the plug insertion tubes 41 in the water jacket compartments 35. The walls 51 extend along the array of cylinders 11 and each have a relatively small width $H_1$ near the lower side 7c and a relatively large width $H_2$ near the upper side 7d.

Stated otherwise, as viewed in the direction in which cooling water flows in each of the water jacket compartments 35, the confronting walls 51 in each water jacket compartment 35 have outer edges shaped complementarily to the outer profiles of the upper wall of the cylinder 11 (i.e., the lower side 7c of the cylinder head 7) and the plug insertion tube 41, thus defining a passageway P between the outer edges of the confronting walls 51, the upper wall of the cylinder 11 and the plug insertion tube 41. As viewed in said direction, the passageway P has a substantially constant width from portions 55, 41 which are to be cooled by the cooling water flowing through the passageway P. The walls 51 projecting from the respective partitions 33 have air holes 53 defined respectively therethrough near the upper side 7d of the cylinder head 7 for the passage of air therethrough.

The walls 51 serve to reinforce the partitions 33 when the cylinder head 7 is fastened to the cylinder block 5, and also to hold the lower side 7c of the cylinder head 7 intimately against the upper surface of the cylinder block 5 for hermetically closing the cylinder bores 13 reliably.

A plurality of concentric arcuate fins 57 project from the bottom wall 55 of the lower side 7c of the cylinder head 7 which defines each of the water jacket compartments 35, the arcuate fins 57 being arranged at spaced intervals from the partitions 33 and the end wall 32 toward the plug insertion tubes 41. Each of the fins 57 extends from one side 7a toward the other side 7b of the cylinder head 7 while being convexly curved toward the plug insertion tube 41, i.e., the center of the cylinder bore 13. Some of the fins 57 near the plug insertion tube 41 are disposed in the passageway P.

The water jackets 27 comprise annular water jackets defined along the outer circumferential surfaces of the respective cylinder liners 15. The water jackets 27 have the cooling water inlet ports or passages 63 opening toward the tubular intake walls 39 and opening into the communication passage or water jacket extension 47 defined in the cylinder head 7.

Operation of the cylinder head cooling structure 100 will be described below.

Cooling water is supplied by the non-illustrated water pump into the cooling water supply passageways 29 associated with the respective arrays of cylinders 11, and then is branched from the cooling water supply passageways 29 through the branch passages 31a and the ports 31b into the water jackets 25, 27.

The cooling water supplied into the water jackets 27 around the cylinder bores 13, i.e., the cylinder liners 15 cools the outer circumferential surfaces of the cylinder liners 15, and thereafter flows through the passages 63 into the water jacket extension 47.

The water jacket compartments 35 of the water jacket 25 in the cylinder head 7 are supplied with cooling water from the branch passages 31a. The supplied cooling water first cools the exhaust walls 37 and then cools the bottom wall 55 of the water jacket compartments 35 and the plug insertion tubes 41. Then, the cooling water reaches the intake walls 39, and after having cooled the intake walls 39, flows through the common water jacket extension 47 toward the discharge port 45 from which the cooling water is discharged into the radiator. The cooling water which has entered the water jacket extension 47 from the water jackets 27 around the cylinder liners 15 is also discharged from the discharge port 45 toward the radiator.

The confronting walls 51 projecting into each of the water jacket compartments 35 have such different widths $H_1$, $H_2$ that the cooling water flowing through the water jacket compartment 35 is forced by the walls 51 to flow near the bottom wall 55 and the plug insertion tube 41 for efficiently cooling the bottom wall 55 in its entirety and the plug insertion tube 41. More specifically, the outer edges of the projecting walls 51 are shaped complementarily to the outer profiles of the upper wall of the cylinder 11 and the plug insertion tube 41 which confront the outer edges of the walls 51. Therefore, as viewed in the direction in which the cooling water flows through the water jacket compartment 35, the passageway P has a substantially constant width from the surfaces of the portions 55, 41 to be cooled. As a result, the cooling water passes uniformly near the surfaces of the upper wall of the cylinder 11 and the plug insertion tube 41 to efficiently cool them.

Air which may be contained in the cooling water introduced into the water jacket compartments 35 escapes through the air holes 53 defined in the walls 51 into the water jacket extension 47, and is finally discharged out of the cylinder head 7. As can be understood from FIG. 1, the walls 51 as well as the cylinders 11 are inclined in use, but air is prevented from being trapped below the inclined walls 51. Any air bubbles which may have reached areas below the inclined walls 51 are allowed to pass through the air holes 53 with streams of the cooling water and also under their own buoyancy in the cooling water.

The concentric arcuate fins 57 are effective in increasing heat radiation from the bottom wall 55 of each of the water jacket compartments 35. When the cooling water flows in the water jacket compartments 35 from one side 7*a* of the cylinder head 7 through the passageways P toward the other side 7*b* of the cylinder head 7, the cooling water is guided by the arcuate fins 57 toward the centers of the cylinder bores 13, i.e., the plug insertion tubes 41. Therefore, the cooling water is prevented from staying stagnant within the water jacket compartments 35.

With the present invention, as described above, the walls 51 projecting from the partitions 33 and the end wall 32 in the cylinder head 7 enables the cooling water to reliably and efficiently cool the valve seats for the exhaust and intake valves 21, 23, the tubular exhaust walls 37, the tubular intake walls 39, and the plug insertion tubes 41 which are positioned above the cylinders.

While the walls 51 are shown as projecting perpendicularly from the partitions 31, the walls 51 may project, for example, in the direction in which the cooling water flows.

Although there has been described what is at present considered to be the preferred embodiment of the present invention, it will be understood that the invention may be embodied in other specific forms without departing from the essential characteristics thereof. The present embodiment is therefore to be considered in all aspects as illustrative, and not restrictive. The scope of the invention is indicated by the appended claims rather than by the foregoing description.

We claim:

1. A cooling structure in a cylinder head of a water-cooled multicylinder engine, comprising:

a plurality of partitions disposed between cylinders and in a water jacket defined in the cylinder head;

a plurality of plug insertion tubes disposed vertically above substantially central portions of the respective cylinders;

a plurality of cooling inlet ports disposed on one side of said plug insertion tubes and a cooling water discharge port disposed on the other side of said plug insertion tubes;

a plurality of walls projecting from said partitions toward said plug insertion tubes; and each of said walls including a lower projecting portion having a relatively small width near a wall of the cylinder head above a combustion chamber defined in each of said cylinders and an upper projecting portion having a relatively large width.

2. A cooling structure according to claim 1, wherein each of said walls has an air hole for passage of air therethrough which is defined in said upper portion.

3. A cooling structure according to claim 1, wherein said wall of said cylinder head above the combustion chamber has at least one fin disposed between adjacent two of said partitions and extending from said one side to said other side of said plug insertion tubes, said fin being convexly curved toward the plug insertion tube between said adjacent two partitions.

4. A cylinder head cooling structure in a water-cooled multicylinder engine, comprising:

a cylinder block;

a cylinder head mounted on said cylinder block and cooperating with the cylinder block in forming at least two cylinders arrayed in first direction;

a water jacket defined in said cylinder head between one side and other side of said cylinder head in a second direction normal to said first direction, said water jacket extending in said first direction above said cylinders;

a plurality of partitions disposed in said water jacket and between said cylinders and extending in said second direction in said cylinder head;

said water jacket having a plurality of water jacket compartments defined between said partitions and between outermost ones of said partitions and end walls of said cylinder head in said first direction, said water jacket compartments being positioned above said cylinders, respectively;

exhaust and intake valves disposed in each of said water jacket compartments above each of said cylinders and in said one side and said other side, respectively, of said cylinder head;

cooling water inlet ports defined in said cylinder head in communication with said water jacket compartments, respectively, and disposed near said exhaust valves, respectively, and a cooling water outlet port defined in said cylinder head in communication with said water jacket compartments and disposed near said intake valves;

a plurality of plug insertion tubes disposed in said water jacket compartments above substantially central portions of said cylinders, respectively, and extending from a lower surface to an upper surface of said cylinder head;

a plurality of walls projecting in said first direction from said partitions and end walls of said cylinder head toward said plug insertion tubes within said water jacket compartments, respectively; and each of said walls including a projecting portion near said lower surface of said cylinder head and having a relatively small width and a projecting portion near said upper surface of said cylinder head and having a relatively large width.

5. A cylinder head cooling structure according to claim 4, wherein each of said partitions has an air hole for passage of air therethrough which is defined in said portion thereof near said upper surface of said cylinder head.

6. A cylinder head cooling structure according to claim 4, wherein said cylinder head has on said lower surface thereof at least one fin disposed in each of said water jacket compartments and extending from said one side to said other side of said cylinder head, said fin being convexly curved toward the plug insertion tube between adjacent two of said partitions.

7. A cylinder head cooling structure in a water-cooled multicylinder engine, comprising:

a cylinder block;

a cylinder head mounted on said cylinder block and cooperating with the cylinder block in forming at least two cylinders;

a water jacket defined in said cylinder head;

a plurality of partitions disposed in said water jacket and between said cylinders;

said water jacket having a plurality of water jacket compartments defined between said partitions and between outermost ones of said partitions and end walls of said cylinder head, said water jacket compartments being positioned above said cylinders, respectively;

a plurality of plug insertion tubes disposed in said water jacket compartments above said cylinders, respectively, and extending from a lower surface to an upper surface of said cylinder head;

cooling water inlet ports defined in said cylinder head in communication with said water jacket compartments, respectively, on one side of said plug insertion tubes, and a cooling water outlet port defined in said cylinder head in communication with said water jacket compartments on the other side of said plug insertion tubes;

a plurality of walls projecting from said partitions and said end walls of said cylinder head toward said plug insertion tubes and defining cooling water passageways between said cooling water inlet ports and said cooling water discharge port; and said cooling water passageways having a substantially constant width from surfaces of an upper wall of said cylinders and said plug insertion tubes which are to be cooled, as viewed in a direction in which cooling water flows through the cooling water passageways.

8. A cylinder head cooling structure according to claim 7, wherein said upper wall of said cylinders has at least one cooling water guide-fin disposed in each of said passageways in said water jacket compartments.

9. A cylinder head cooling structure according to claim 7, wherein said cylinder head has exhaust and intake passages associated with each of said cylinders and defined in each of said water jacket compartments on said one and other sides of said plug insertion tubes, the arrangement being such that cooling water introduced from said cooling water inlet ports into said water jacket compartments first cools said exhaust passages, then said upper wall of said cylinders and said plug insertion tubes while passing through said passageways, and thereafter said intake passages, and is discharged from said cooling water discharge port.

* * * * *